US006134417A

United States Patent [19]

Fukasawa

[11] Patent Number: 6,134,417

[45] Date of Patent: Oct. 17, 2000

[54] AUTOMATIC DOCUMENT FEEDING APPARATUS FOR SIMPLEX, DUPLEX AND 2-IN-1 DOCUMENT HANDLING

[75] Inventor: Eiji Fukasawa, Yamanashi-ken, Japan

[73] Assignee: Nisca Corporation, Yamanashi-ken, Japan

[21] Appl. No.: 09/039,720

[22] Filed: Mar. 16, 1998

[30] Foreign Application Priority Data

Mar. 14, 1997 [JP] Japan ..... 9-081833

[51] Int. Cl.[7] ..... G03G 15/00

[52] U.S. Cl. ..... 399/367; 399/374

[58] Field of Search ..... 399/367, 371, 399/372, 374

[56] References Cited

U.S. PATENT DOCUMENTS 5,371,580 12/1994 Kato et al. ..... 399/374 X
5,532,809 7/1996 Hamanaka et al. ..... 399/371
5,822,672 10/1998 Johdai et al. ..... 399/371 X

FOREIGN PATENT DOCUMENTS 6-263332 9/1994 Japan .

*Primary Examiner*—Fred L Braun

*Attorney, Agent, or Firm*—Kane, Dalsimer, Sullivan and Levy, LLP

[57] ABSTRACT

An automatic document feeding apparatus includes a document supplying mechanism having a supply passage incorporating at least one kick roller, pressure mechanism, document separating mechanism and registering mechanism so as to send documents one by one toward a document reading station defined on an image forming apparatus such as a copying machine, a document transferring mechanism for moving the document along the document reading station to read out or copy the document, and a document discharging mechanism having a discharge passage for sending out the processed document and a return passage for inverting and sending back the processed document to the document reading station. The document supplying mechanism, document transferring mechanism and document discharging mechanism can be arbitrarily driven by controlling a single drive source, two electromagnetic clutches and one-way clutches constituting a motion transmitting system. The document feeding can be readily carried out according to the required one selected from a simplex copying mode for dealing with a simplex document, a duplex copying mode for dealing with and inverting a duplex document, and a 2-in-1 mode for dealing with two documents placed side by side on the document reading station at one time.

17 Claims, 14 Drawing Sheets

AUTOMATIC DOCUMENT FEEDING APPARATUS FOR SIMPLEX, DUPLEX AND 2-IN-1 DOCUMENT HANDLING

BACKGROUND OF THE INVENTION

1. Field of the Invention

This invention relates to an apparatus for automatically feeding one or more documents to an image forming apparatus such as a copying machine, and more particularly to an automatic document feeding apparatus capable of continuously sending simplex or duplex original documents to a document reading station in the image forming apparatus with high efficiency in accordance with a desired document feeding mode by using a document feeding mechanism simple in structure and easy to control.

2. Description of the Prior Art

An automatic document feeder (ADF) has become to be applied for automatically sending one or more original documents in succession to a document reading station in an image forming apparatus such as a copying machine, facsimile and image scanner. Coping with a need which has been felt for high-speed image processing in the image forming apparatus as noted above, the automatic document feeder has been desired to operate at high speed. Furthermore, there has been a need for a small-sized and energy-saving document feeder.

For introducing automation into the document feeder, it is necessary to fulfill a function of handling not only a simplex document having information to be read out on its one side, but also a duplex document having information on its both sides. Conventional document feeders possessing such a function are disclosed in U.S. Pat. No. 5,280,330; U.S. Pat. No. 5,327,205; U.S. Pat. No. 5,377,966; U.S. Pat. No. 5,601,281; and Japanese Patent Application Public Disclosure No. HEI 6-263332(A).

For instance, the automatic document feeding apparatus disclosed in Japanese Patent Appln. Pub. Discl. No. HEI 6-263332(A) is composed of a lot of motion transmitting components including gears, timing belts, pulleys, levers, electromotive clutches and electromotive solenoids for transmitting the motive power generated by a single drive source (motor) to a drive means, and further employs a plurality of detecting elements such as a rotary encoder for observing the movement of the motion transmission components. Thus, the prior art document feeders ordinarily necessitate such complicated driving and controlling mechanisms consisting of the single drive source and many driving components including feeding rollers and powered actuators with electromotive clutches and electromotive solenoids, which must be operated and controlled with exquisite timing. It is a matter of course that the conventional document feeders are basically limited in their operation speed and complicated in structure.

In general, to feed the original documents from a document supply tray of the document feeder to a document reading station of the image forming apparatus, the original documents are sent out one by one from the document supply tray in such a manner that after the preceding document is read out at the document reading station and discharged therefrom, the following document starts from the document supply tray toward the document reading station. Consequently, until the following document from the document supply tray reaches the document reading station, the image forming apparatus is temporarily suspended to wait for the following document, resulting in a time loss. In an inefficient document feeder, until the preceding document subjected to image processing is completedly discharged from the document feeder, the feeder does not start to feed the following document, consequently to remarkably lengthen the intervals of time at which the original documents are sent out one by one from the document supply tray, and decrease the operation speed.

In a case of dealing with duplex documents, a process for inverting the document is required, resulting in decrease in operation speed and prolongation of the processing period.

In principle, even the conventional document feeder as noted above may possibly be operated at high speed by elevating the operation speed of the driving component elements. However, the speeding up of the operation of the component elements involves many problems such as occurrence of excessive inertia, degradation of performance and reliability, and production of noises.

There may be considered an idea such that during image processing for the preceding document at the document reading station, the following document is sent out from the document supply tray to be beforehand brought near the document reading station just after the preceding document processed goes out of the document reading station so as to replace the documents at the document reading station at a short interval of time. Nevertheless, the conventional document feeders as described above are not possessed of a mechanism capable of embodying the aforementioned idea for speeding up the document feeding operation.

Moreover, the document feeder for the image forming apparatus has been desired to offer a "2-in-1" function of reading out images on two original documents placed side by side on the document reading station at one time. To give one example of the 2-in-1 function, two original documents of A4 size are placed side by side on the document reading station and read out in one operation to obtain a copy of A3-size on which the images of the two original documents are reproduced or a reduced copy of A4 size to which the images copied from the original documents of A4 size are reduced. The 2-in-1 function contributes toward speeding up of the operation of the image forming apparatus, but could not easily be fulfilled by the conventional document feeding apparatuses.

OBJECT OF THE INVENTION

An object of the present invention is to provide an automatic document feeding apparatus capable of automatically feeding one or more original document to an image forming apparatus such as a copying machine at great speed with high efficiency by use of a document transferring mechanism simple in structure and easy to control.

Another object of the present invention is to provide an automatic document feeding apparatus capable of automatically and reliably handling simplex and duplex documents at high speed and aptly fulfilling a 2-in-1 function of dealing with two original documents to be read out in one reading operation.

Still another object of this invention is to provide an automatic document feeding apparatus capable of reliably carrying out consecutive document handling operation from a document supplying process to a document discharging process by use of a single reversible drive source producing rotations in opposite directions and driving components including simply operable motion transmitting means such as gears, timing belts, one-way clutches and the least possible number of electromotive clutches without using any specific controlling system complicated in mechanism.

Yet another object of this invention is to provide a high-performance automatic document feeding apparatus capable of carrying out the document feeding operation at high speed in such a manner that, during image processing for the preceding document at a document reading station of an image forming apparatus, the following document beforehand advances near the document reading station in the process of reading out the preceding document at the document reading station so as to replace the documents at the document reading station at a short interval of time.

SUMMARY OF THE INVENTION

To attain the objects described above according to this invention, there is provided an automatic document feeding apparatus comprising a document supplying mechanism including a document supply tray for stacking one or more original documents to be read out, at least one kick roller for sending out the documents from the document supply tray one by one, document separation means for permitting one document from the document supply tray to pass therethrough at one time, and registering means for correcting inclination of the document being forwarded relative to a document forwarding direction; a document transferring mechanism for moving the document along a document reading station; a document discharging mechanism including a document discharge tray for receiving the documents discharged, a delivery roller for sending the document along a transfer passage formed therearound, a discharge passage through which the document sent out from the document reading station via the transfer passage is guided toward the document discharge tray, a return passage through which the document sent out from the document reading station via the transfer passage is returned to the document reading station in its inverted state, and a changeover means for selectively introducing the document sent out from the document reading station via the transfer passage to the discharge passage or the return passage; and a motion transmitting system including a single drive source to be operated in accordance with the document being transferred.

The motion transmitting means includes gears, timing belts, sprockets, one-way clutches, and electromotive clutches, so that the rotational motion produced by the drive source such as a motor is transmitted to the driving components in the respective document supplying mechanism, document transferring mechanism and document discharging mechanism via the one-way clutches and electromotive clutches. The one-way clutches and electromotive clutches are activated or deactivated according to the direction of the rotation of the drive source, consequently to decide as to whether the rotational motion is transmitted to the respective document supplying mechanism, document transferring mechanism and document discharging mechanism.

In a case of dealing with a simplex document having information to be read on its one side, the given document is merely sent from the supply tray in the document supplying mechanism to the discharge tray in the document discharging mechanism through the document transferring mechanism. Meanwhile, in a case of giving a plurality of simplex documents, during the image processing for the preceding document at the document reading station defined on the image forming apparatus, the following document is sent to a wait position determined just before the document reading station, so that the following document advances toward the document reading station while the preceding document upon being processed is sent out from the document reading station. Thus, the time for putting the following document on standby for carrying out desired image processing is shortened, consequently to fulfill the speeding up of the operation of the apparatus.

When a duplex document having information to be read on its both sides is given, it is once sent into the document discharging mechanism upon completion of reading out the information on one side, and then, sent back to the document reading station for reading out the information on the other side.

In a case of carrying out the 2-in-1 function of dealing with two original documents at one time, the first document is sent to the document reading station until the tail end of the first document reaches a reading reference point, and then, the second document is forwarded to the document reading station. When the leading end of the second document reaches the reading reference position, the first and second documents together are sent forward until the rear end of the second document arrives at the reading reference position. Thus, the first and second documents are placed side by side in position on the image reading station so as to be read out in one reading operation.

Other objects and features of the present invention will be hereinafter explained in detail with reference to the accompanying drawings.

DESCRIPTION OF THE PREFERRED EMBODIMENTS

This invention relates to an automatic document feeding apparatus capable of automatically feeding original documents in the suitable condition according to various copying modes, i.e. a simplex copying mode for dealing with simplex documents each having information to be read or copied on its one side, a duplex copying mode for dealing with duplex documents each having information to be read or copied on its both sides, a 2-in-1 copying mode for copying two documents in one reading operation, and a manual insertion mode for manually inserting a document into the apparatus. The document feeding apparatus can be operated at high speed merely by changing the direction of the rotation of a single drive source without using a specific controlling system complicated in mechanism.

Figure 1:
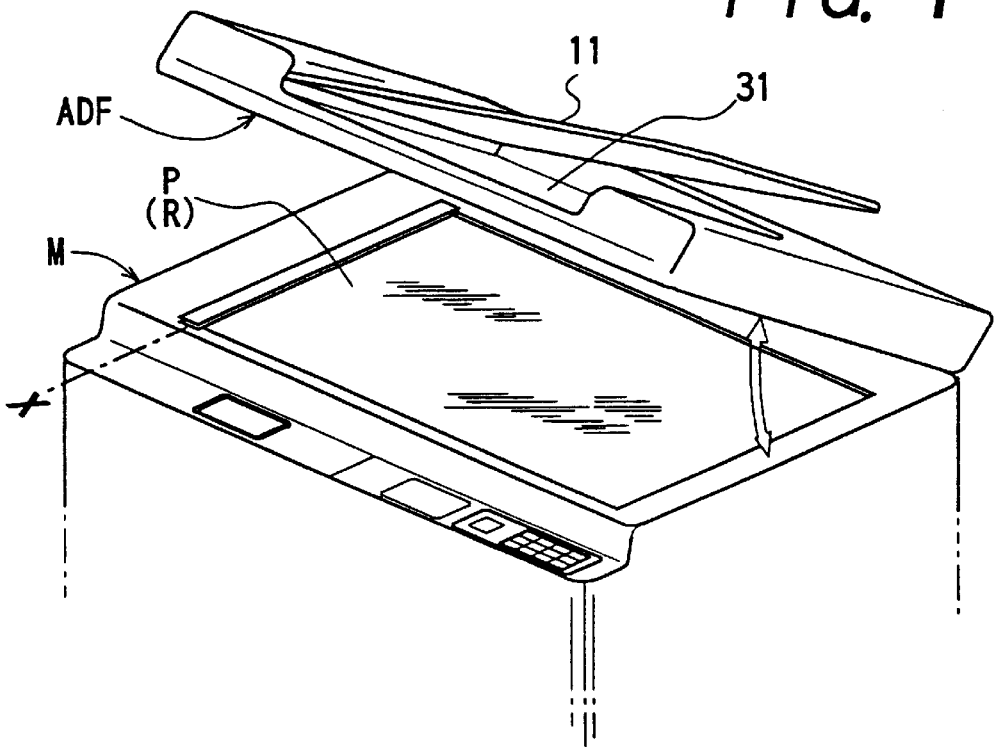
FIG. 1 is a perspective view showing an automatic document feeding apparatus according to this invention, which is applied to an image forming apparatus as one example.
Figure 3:
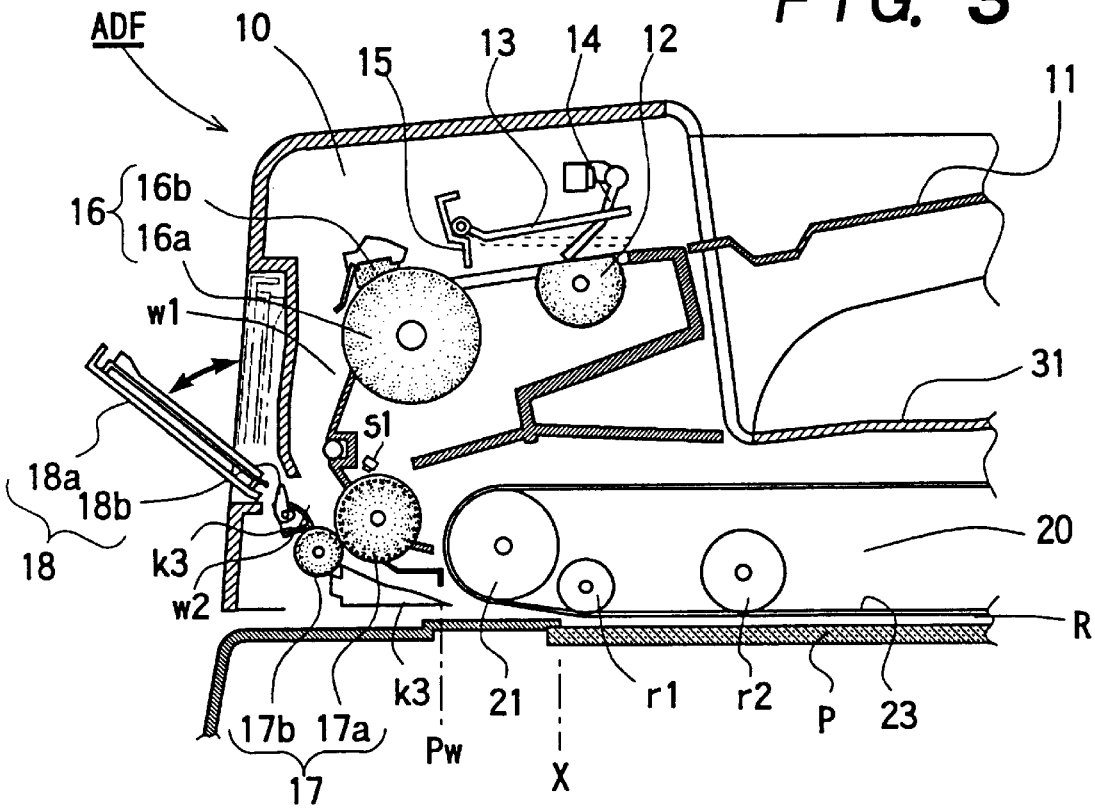
FIG. 3 is an enlarged view of a document supplying mechanism in the apparatus of FIG. 2.
Figure 2:
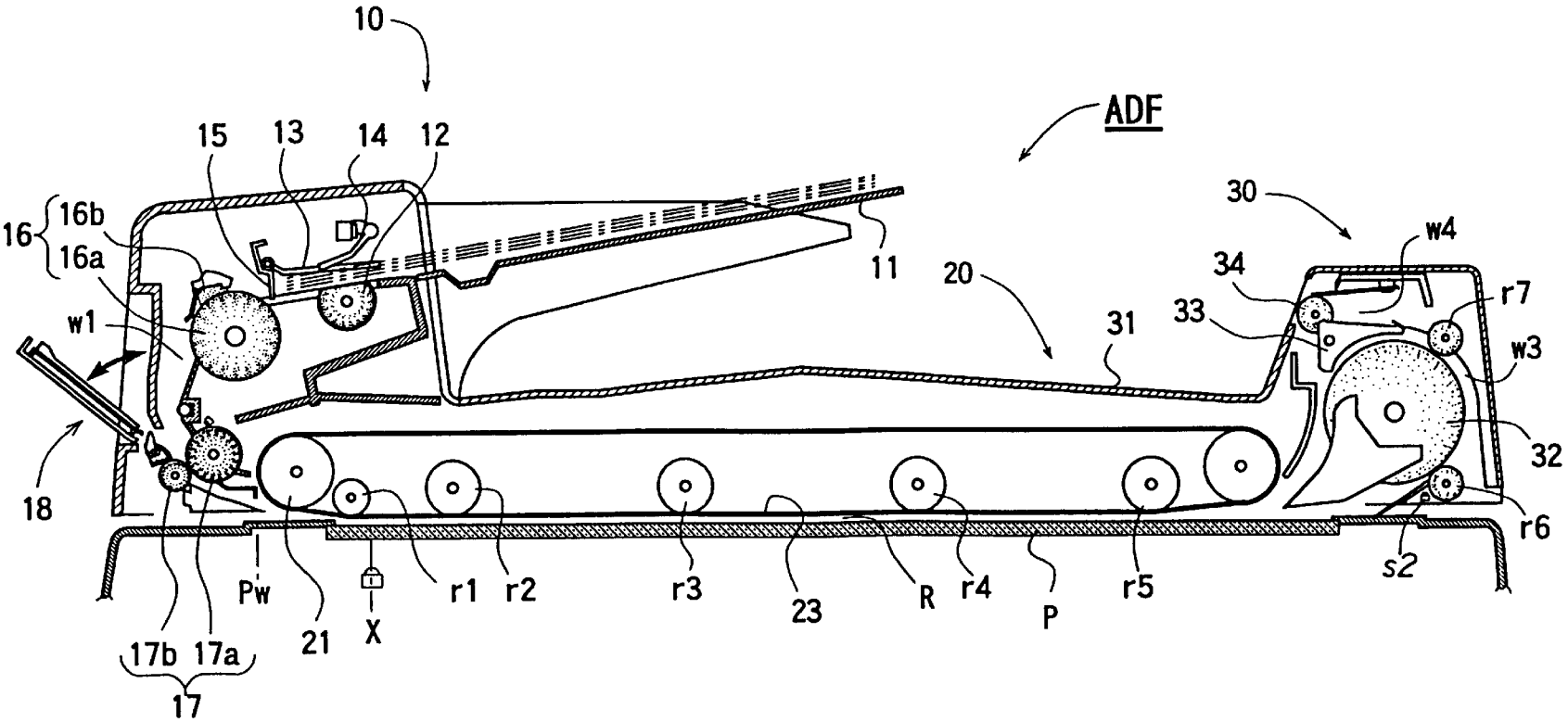
FIG. 2 is a front sectional view schematically showing one embodiment of the document feeding apparatus according to this invention.

FIG. 1 illustrates one example of the automatic document feeding apparatus ADF according to this invention which is applied to a copying machine M typical of an image forming apparatus. However, this invention does not contemplate imposing any limitation on the type of the apparatus or system to which this invention is applied, and is applicable to any other desired devices or equipments such as a facsimile, image scanner and so on. Incidentally, the apparatus ADF of the invention is placed openably upward on a transparent platen P of the copying machine M so as to overlay a document reading station R defined on the platen as shown in FIG. 1, but this formation should not be understood as being limited thereto.

The illustrated copying machine M is provided beneath the document reading station R with an image reading element IR. By moving a moving image reading element IR relative to the given document rested on the document reading station or moving the given document relative to a stationary image reading element IR secured on the copying machine M to optically scan the document, optical image reading is carried out to obtain desired image data. In a copying machine having the stationary image reading element IR, at the position of the image reading element, there is defined a reading reference point X for starting to scan the given document to be read.

The automatic document feeding apparatus of the invention comprises a document supplying mechanism 10 accommodating one or more original documents D (d1,d2, . . . ) to be read out or copied to send out the documents toward the document reading station R, a document transferring mechanism 20 overlaying the document reading station R to move to and fro the document in a document transferring direction along the document reading station R, and a document discharging mechanism 30 for permitting the document processed at the document reading station to be discharged or returned to the document reading station R.

The document supplying mechanism 10 having a supply passage w1 comprises a document supply tray 11 for stacking one or more documents D to be read, at least one kick roller 12 disposed on the bottom of the supply tray 11 to send out the documents one by one from the document supply tray 11 to the supply passage w1, pressure means 13 coming in press contact with the top of the kick roller 12 so that the document sent out from the supply tray 11 and passing through between the kick roller and pressure means is pressed against the kick roller 12, an empty sensor 14 disposed above the supply tray 11 to detect the aforesaid one or more documents stacked on the supply tray 11, a document stopper 15 disposed on the front end of the supply tray 11 relative to the document forwarding direction to selectively block the passage of the aforesaid one or more documents stacked on the supply tray 11, means 16 for separating two or more documents which together are fed from the supply tray 11 so as to permit only one document to pass therethrough, and registering means 17 disposed on the supply passage w1 to correct the inclination of the document being forwarded along the supply passage w1 to a proper direction.

The supply passage w1 is formed in a generally C-shape inside a housing 10*a* of the apparatus. The kick roller 12, document separating means 16, and registering means 17 are arranged in order along the supply passage w1 extending from the supply tray 11.

By rotating the kick roller 12, the lowermost of the documents stacked on the supply tray 11 is sent out to the supply passage w1. The pressure means 13 touching the top of the kick roller 12 is composed of a lever having one end rotatably supported so as to rotate toward the kick roller 12, thus pressing the documents stacked on the supply tray 11 against the kick roller 12. With this arrangement, the documents can be securely sent out one by one.

The empty sensor 14 is operated in response to one or more documents on the supply tray 11 to issue an output indicative of the existence of the one or more documents stored in the tray.

The document stopper 15 serves to prevent two or more documents from passing therethrough, but permit only the lowermost document to pass therethrough.

The document separating means 16 is formed of at least one document feeding roller 16*a* and a separation pad 16*b* made of frictional material such as rubber and coming into press contact with the document feeding roller 16*a*. Even if two or more documents are accidentally sent out from the supply tray 11 by rotating the kick roller 12 and pass through the document stopper 15 (double feed phenomenon), only the lowest document being in contact with the document feeding roller 16*a* is permitted to pass through the document separating means 16, and the other document or documents are obstructed by the action of the friction of the separation pad 16*b*. As a result, only one document can pass through the separating means at one time.

The registering means 17 is composed of a pair of opposed registering rollers 17*a* and 17*b*. When the document advances aslant along the supply passage w1 with the aid of the rotating document feeding roller 16*a*, the inclination of the document being forwarded relative to the document forwarding direction is corrected by the registering means. That is, the correction for the inclination of the document is effected in such a manner that the registering rollers 17*a* and 17*b* continue stopping just after the leading edge of the document being forwarded along the supply passage w1 collides with the contact line formed between the registering rollers 17*a* and 17*b* which is perpendicular to the document transferring direction. Consequently, the leading end of the document comes into collision with the contact line of the registering rollers, thus to be aligned with the contact line. Then, the registering rollers 17*a* and 17*b* start rotating just after the document collides with the contact line of the registering rollers, as a result of which the document is forwarded through the registering means 17 while being directed to the proper transferring direction. Hence, the inclination of the document is appropriately corrected.

The aforementioned supply tray 11, kick roller 12, pressure means 13, empty sensor 14, document stopper 15, document separating means 16 and registering means 17 which constitute the document supplying mechanism 10 are not specifically peculiar to this invention, and this invention is by no means limited to the illustrated formation.

Disposed between the separating means 16 and the registering means 17 on the supply passage w1 is a manual insertion mechanism 18 for inserting a document to be processed into the apparatus by hand. The manual insertion mechanism 18 comprises a manual insertion tray 18*a* disposed openably on the side of the housing 10*a* of the apparatus, and a manual insertion shutter 18*b*. In the other modes than the manual insertion mode, a manual insertion passage w2 extending from the manual insertion tray 18*a* to the supply passage w1 is closed by the manual insertion shutter 18*b*.

In the drawings, reference symbol s1 denotes a registering sensor positioned just before the registering means 17. Reference symbols k1 and k2 denote guide members defining the supply passage w1, and k3 denotes a guide member defining the manual insertion passage w2 extending from the manual insertion tray 18 to the supply passage w1. Reference symbol Pw is indicative of a document wait point determined between the registering means 17 and the document reading station R on the supply passage w1.

The document transferring mechanism 20 includes document transferring means 23 such as of one or more endless belts passing around paired transferring rollers 21 and 22.

The transferring rollers 21 and 22 are rotatable reversibly to move to and fro the document along the document reading station R defined between the transparent platen P on the image forming apparatus M and the document transferring means 23 in the forward direction or the reverse direction. Reference symbols r1 to r5 denote auxiliary feeding rollers.

The document discharging mechanism 30 comprises a discharge tray 31 for receiving one or more documents sent out upon complete of the image processing, a delivery roller 32 defining a transfer passage w3 formed along a part of its circumferential surface, a discharge passage w4 for guiding the document from the document reading station R to the discharge tray 31 through the transfer passage w3, a return passage w5 for sending back the document sent from the document reading station R through the transfer passage w3 to the document reading station R in the state of inverting the document, a changeover means for selectively guiding the document from the document reading station R through the transfer passage w3 to the discharge passage w4 or the return passage w5, and document discharging means 34 including discharge rollers 34*a* for sending out the document from the discharge passage to the discharge tray 31. Reference symbols r6 and r7 denote auxiliary rollers, and s2 denotes a document discharging sensor.

By rotating the delivery roller 32 in one direction, the document sent out from the document reading station R is forwarded along the transfer passage w3. In the case of closing the return passage s5 with the changeover means 33 on arrival of document at the changeover means 33, the document is introduced into the discharge passage w4, consequently to be discharged to the discharge tray 31 by the discharge rollers 34*a* in rotation.

In the case of closing the discharge passage w4 with the changeover means 33 when the document arrives at the changeover means 33, the document is sent into the return passage w5 with the rotation of the delivery roller 32 and returned to the document reading station R in its inverted state.

The aforementioned discharge tray 31, delivery roller 32, changeover means 33, and discharging means 34 which constitute the document discharging mechanism 30 are not specifically peculiar to this invention, and this invention is by no means limited to the illustrated formation.

Figure 4:
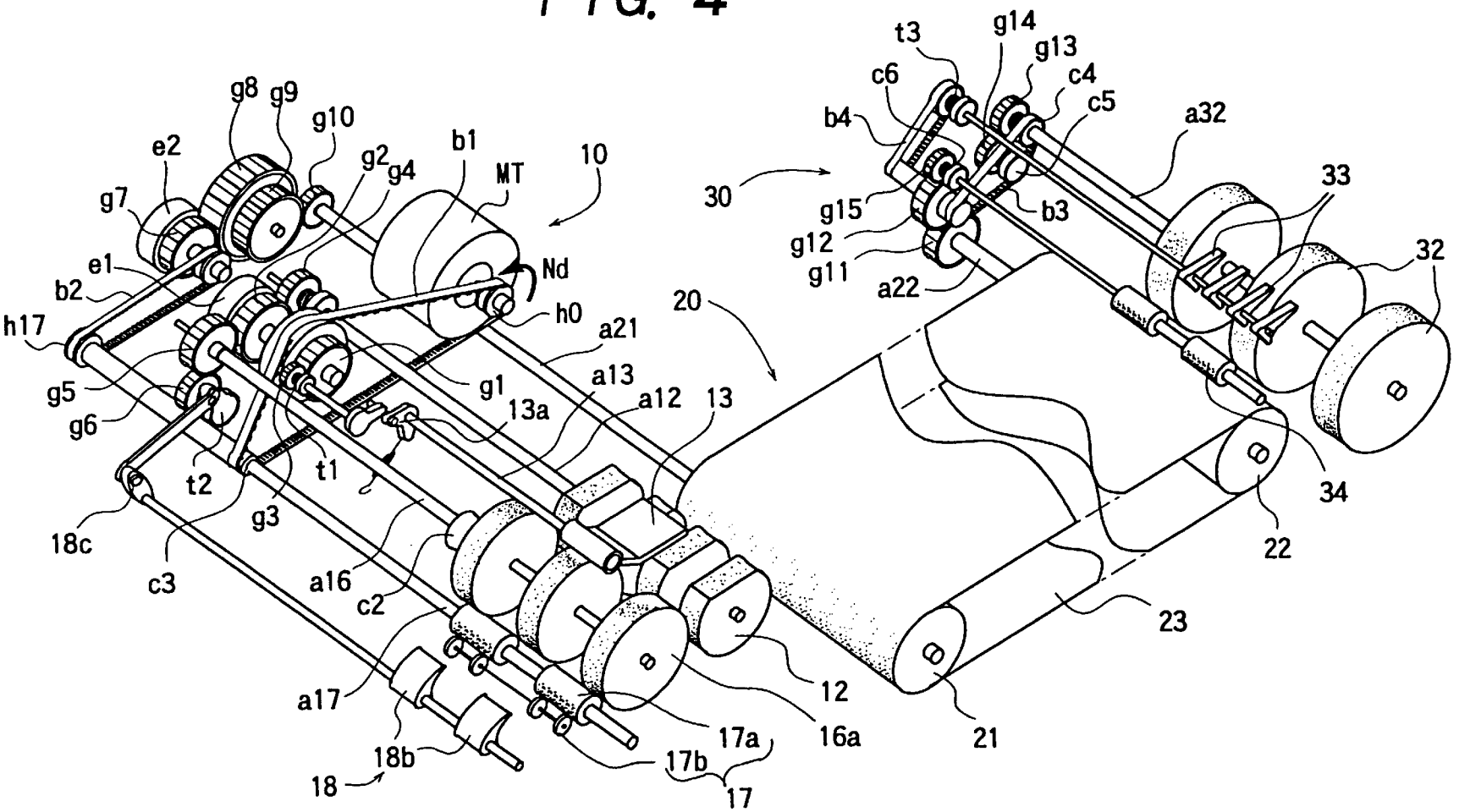
FIG. 4 is a perspective view schematically showing a motion transmitting system in the document feeding apparatus according to this invention.

FIG. 4 depicts a motion transmitting system through which the aforenoted document supplying mechanism 10, document transferring mechanism 20 and document discharging mechanism 30 are driven. Since the system is illustrated partially with exaggeration and deformation in FIG. 4 to facilitate the understanding of the invention, the invention should not be understood as being limited to the illustrated structure and arrangement. FIG. 5 through FIG. 10 illustrate the states in which the driving components of the apparatus are operated in various copying modes. In FIG. 5 through FIG. 10, the components in operation are delineated by thick lines, and the components at rest are delineated by thin lines.

Figure 5:
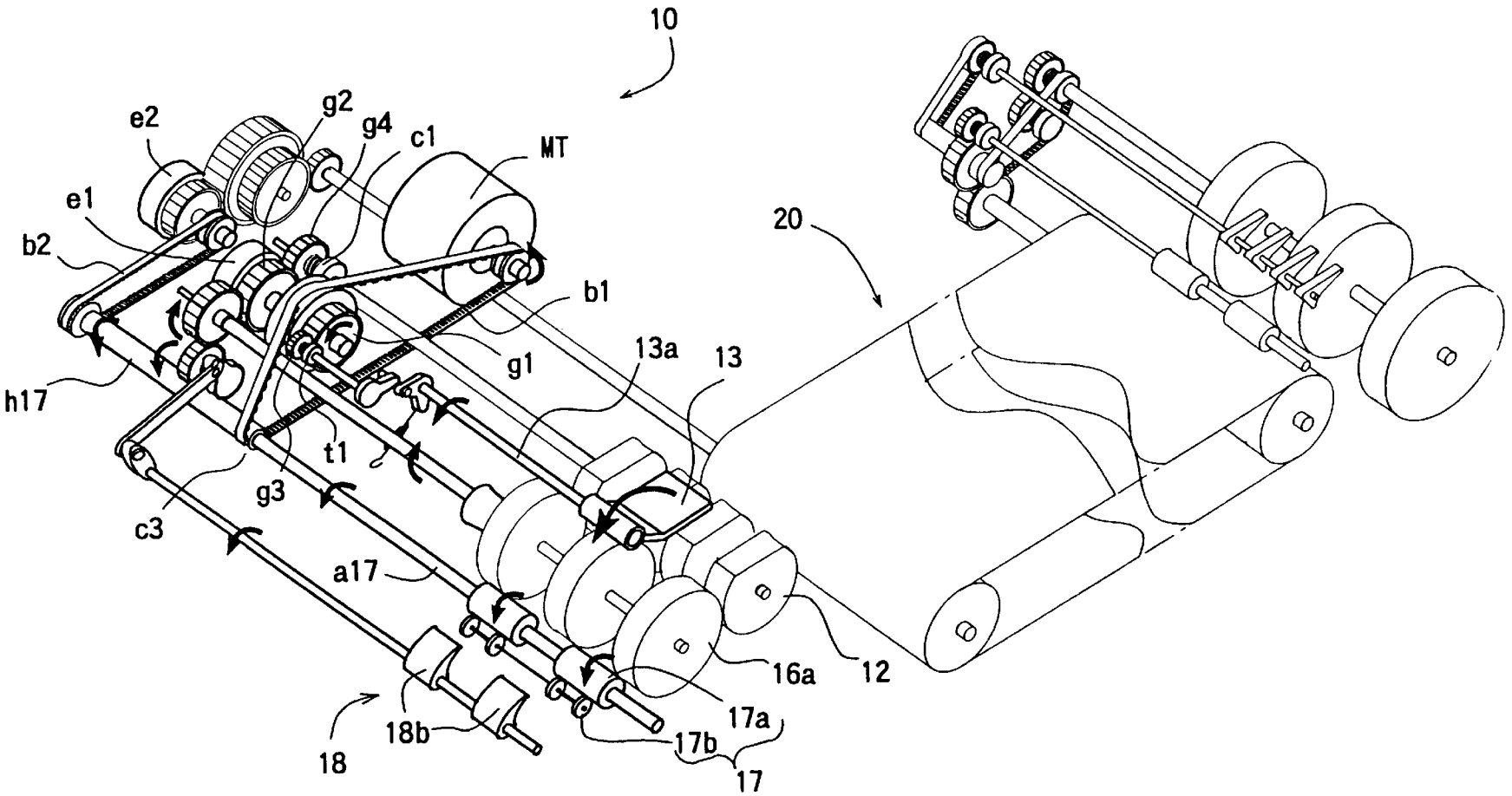
FIG. 5 is a schematic perspective view showing the motion transmitting system in its initial state.
Figure 6:
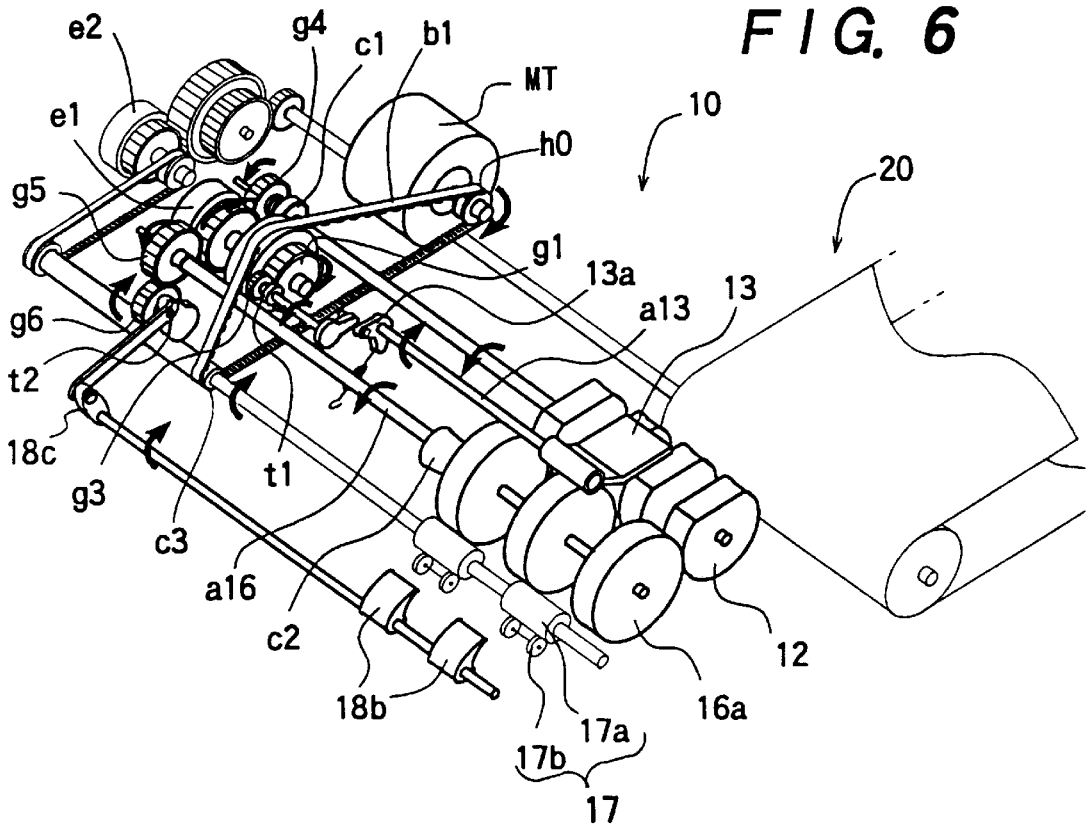
FIG. 6 is a schematic perspective view showing the motion transmitting system when starting its document feeding operation.
Figure 7:
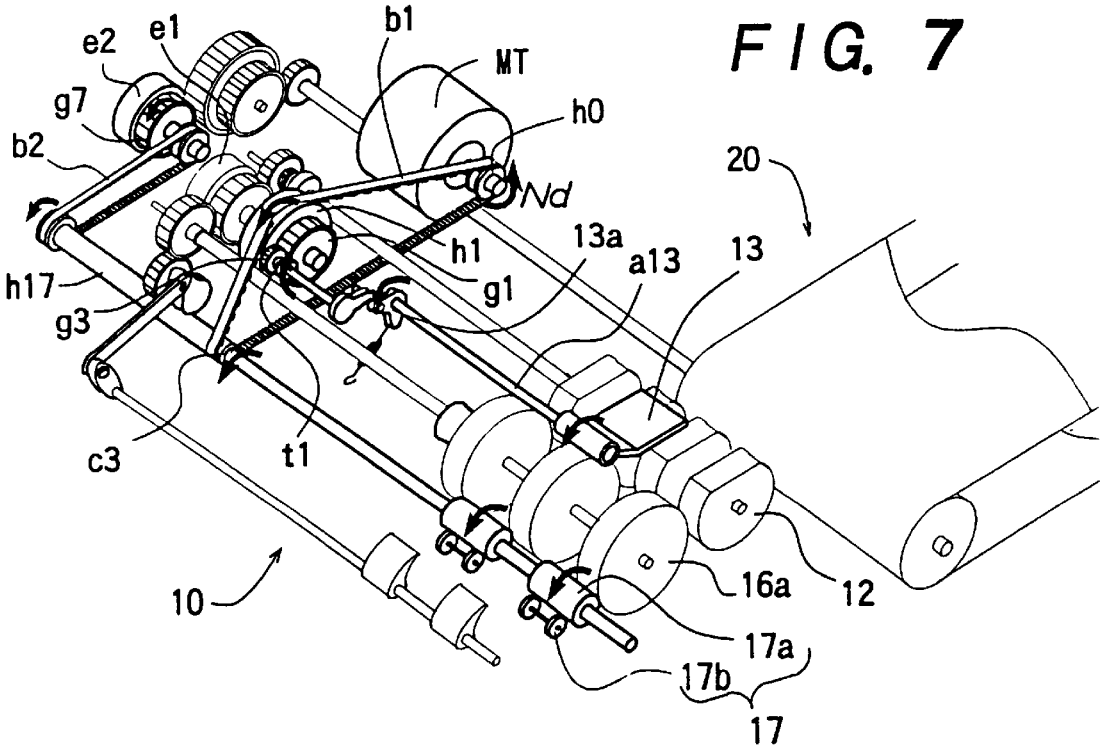
FIG. 7 is a schematic perspective view showing the motion transmitting system in performing a registering operation.
Figure 8:
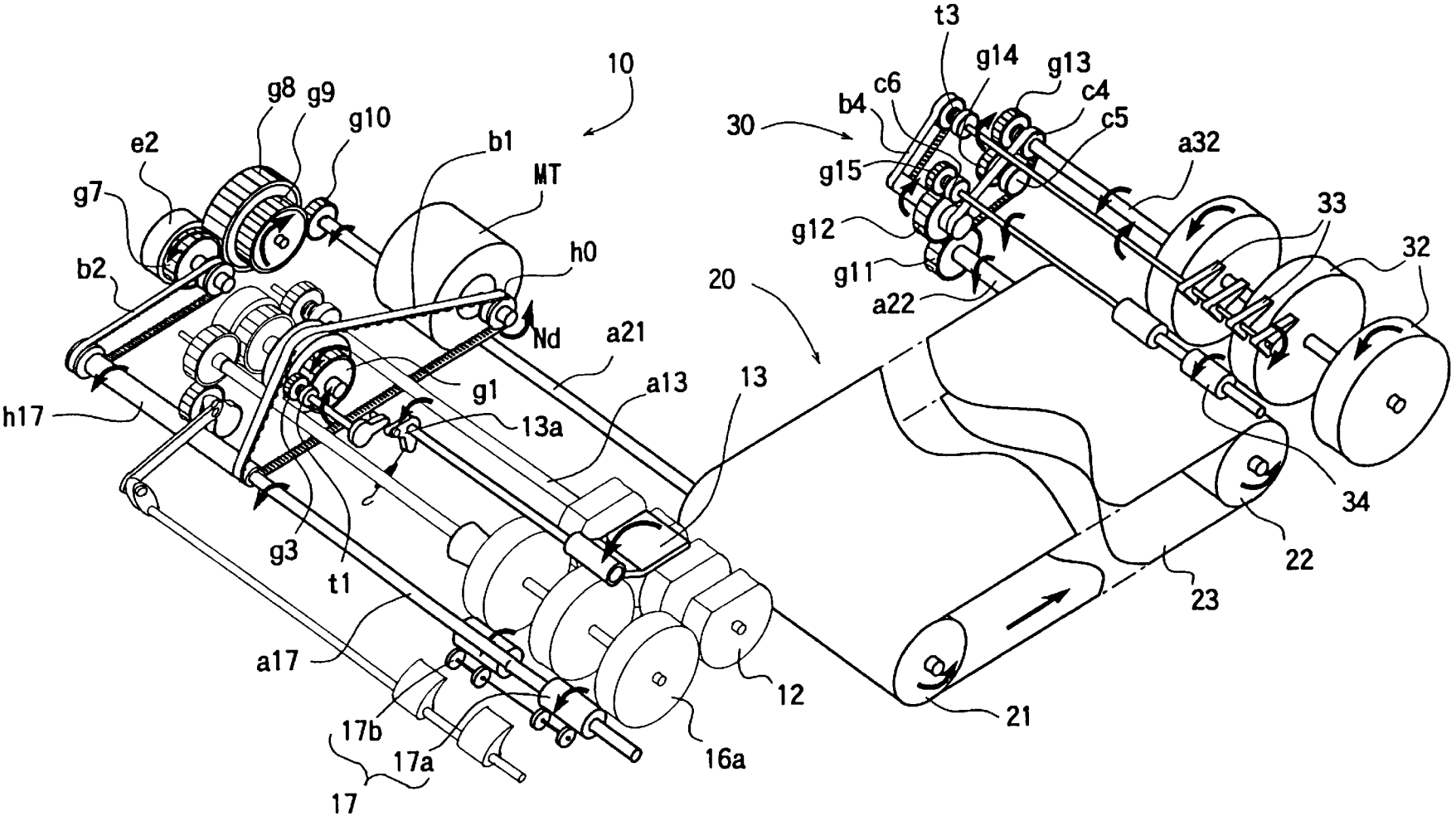
FIG. 8 is a schematic perspective view showing the motion transmitting system in performing a document discharging operation.
Figure 9:
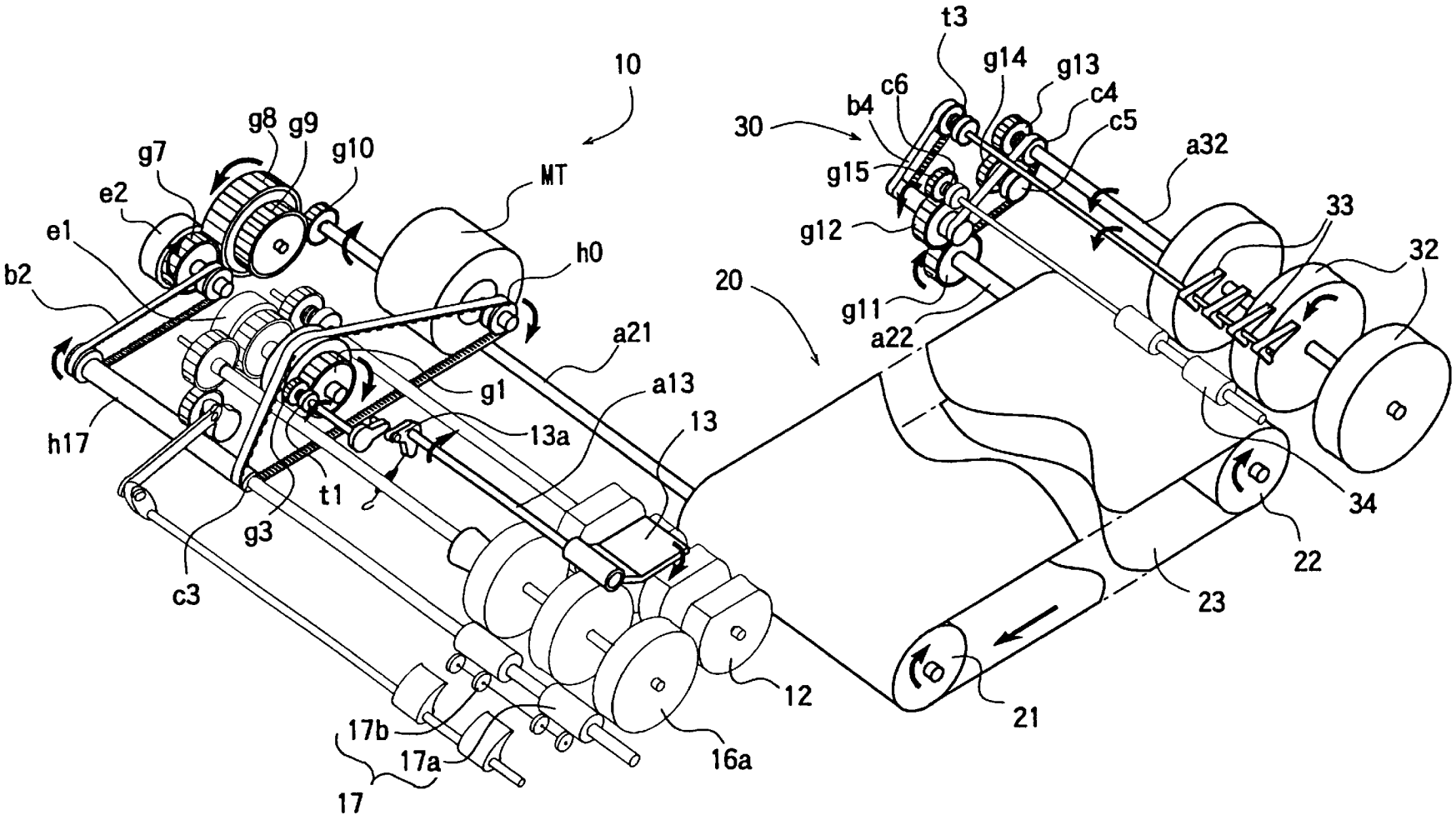
FIG. 9 is a schematic perspective view showing the motion transmitting system in performing a document inverting operation.
Figure 10:
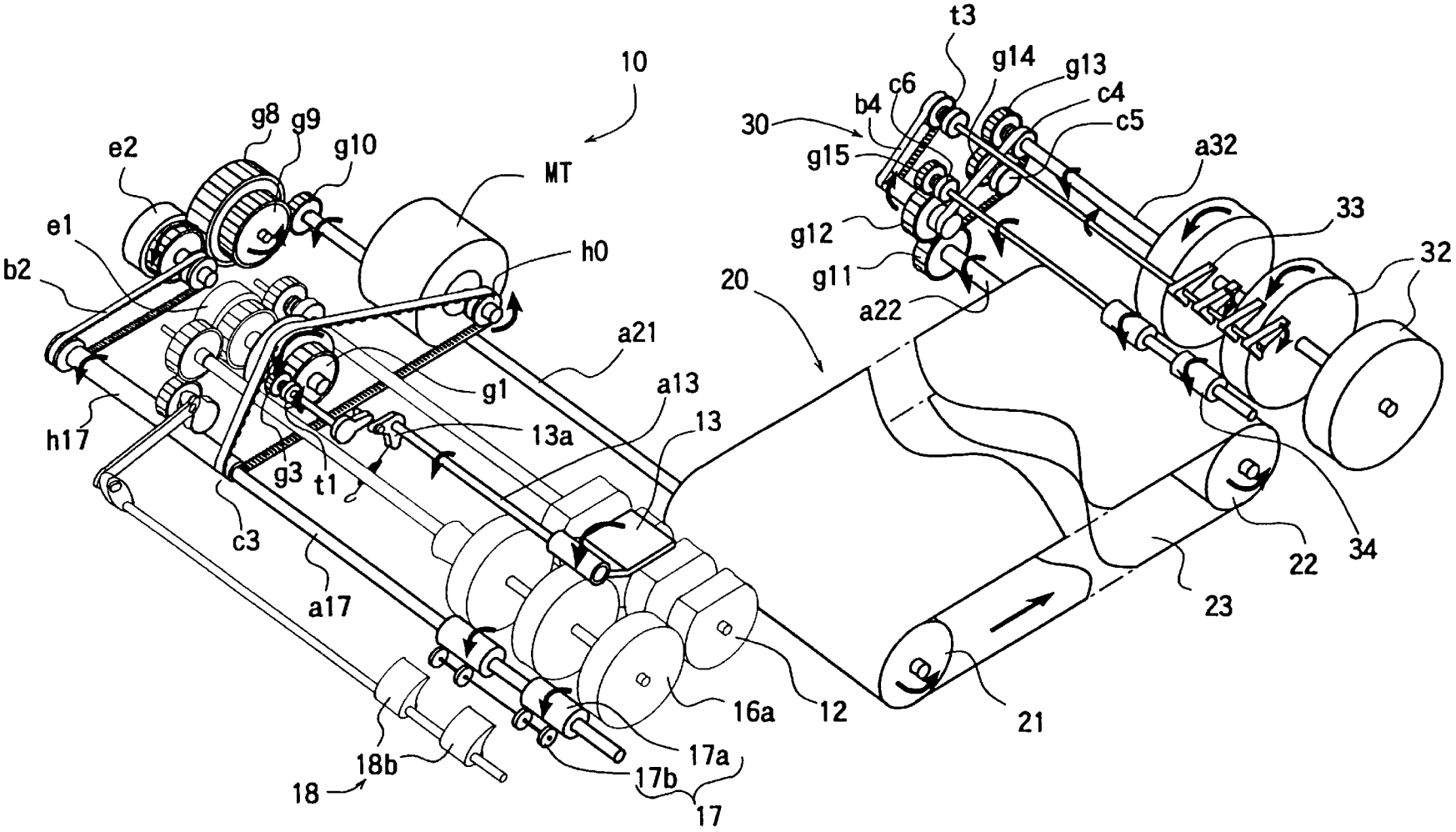
FIG. 10 is a schematic perspective view showing the motion transmitting system in performing a manual insertion operation.

To be more specific, FIG. 5 shows the initial state of the document feeding operation, FIG. 6 shows the document feeding operation, FIG. 7 shows the registering operation, FIG. 8 shows the document discharging operation, FIG. 9 shows the document inverting operation, and FIG. 10 shows the manual insertion operation.

Incidentally, the document feeding apparatus of the invention has an outstanding advantage in that various operation modes as noted above can be rationally carried out merely by driving the motion transmitting system including one-way clutches and two electromotive clutches with the forward or reverse rotation of the single drive source without using a controlling system complicated in structure.

To put it concretely, the motion transmission system in this embodiment of the invention includes a motor MT serving as the drive source capable of generating forward or reverse rotation, gears g1 to g15, torque clutches t1 to t3 for transmitting the rotation with a specific torque, one-way clutches c1 to c6 for permitting the rotation in one direction to be transmitted, first and second electromagnetic clutches e1 and e2 capable of arbitrarily transmitting the rotation, and timing belts b1 to b4.

The motor MT may desirably be of a reversible pulse motor capable of rotational motions in forward and reverse direction and variable in rotational speed. The motor MT is provided on its rotational shaft with a sprocket h0 connected to an intermediate sprocket h1 through the timing belt b1. The intermediate sprocket h1 is united with the gear g1 through a rotational shaft and connected to the gear g2.

The gear g1 is meshed with the gear g3 and connected to the pressure means 13 through the torque clutch c1 and rocking means 13*a*, so as to vertically rock the pressure means 13 with the rotation of the gear g1.

The kick roller 12 has a rotational shaft a12 with the one-way clutch c1 and the gear g4 engaged with the gear g2, so that the kick roller 12 is rotated in the forward direction in which the document is forwarded with the reverse rotation of the motor MT when the first electromagnetic clutch e1 assumes its "connected" state (FIG. 6).

The feed roller 16*a* of the document separating means 16 has a rotational shaft a16 with the one-way clutch c2 and the gear g5 engaged with the gear g2, so that the feed roller 16*a* are rotated in the direction in which the document is forwarded with the reverse rotation of the motor MT when the first electromagnetic clutch e1 assumes its "connected" state.

The registering roller 17*a* of the registering means 17 has a rotational shaft a17 with the sprocket h17 incorporating the one-way clutch c3, so as to be rotated in the forward direction in which the document is forwarded with the forward rotation of the motor MT.

The manual insertion shutter 18*b* of the manual insertion mechanism 18 has a rotation shaft a18 with rockingly driving means 18*c* formed of links, so as to be rockingly moved with the rotation of the motor MT which is transmitted through the gear g6 engaged with the gear g5 and the torque clutch t2. With the rotation of the motor MT, the manual insertion shutter 18*b* is rockingly moved within a specific range by the action of the torque clutch t2. That is, when the motor MT produces the forward rotation, the manual insertion passage w2 is opened by the manual insertion shutter 18*b*.

The rotation of the motor MT is transmitted to the transferring roller 21 of the document transferring mechanism 20 through the sprocket 17 on the rotational shaft a17 of the registering roller 17*a*, the timing belt b2, the gear g7 united with the second electromotive clutch e2, the gears g8 and g9, and the gear g10 on the rotational shaft a21 of the transferring roller 21. The document transferring means 23 of the document transferring mechanism 20 is driven to rotate in the same direction as of the rotation of the motor MT, but selectively controlled by the second electromotive clutch e2.

The document discharging mechanism 30 is operated by the transferring roller 22 driven in concert with the transferring roller 21 of the document transferring mechanism 20. Namely, the transferring roller 22 has a rotational shaft a22 with the gear gill connected to the one-way clutch or spring clutch c4 secured on a rotational shaft a32 of the delivery roller 32 through the gear g12 and the timing belt b3, thus to rotate the delivery roller 32 with the rotation of the transferring roller 22. The one-way clutches c4 and c5 composes a bidirectional clutch. Thus, the forward rotation of the transferring roller 22 is transmitted to the delivery roller 32 through the gears g14, g15 and clutch c5. At this time, the clutch c4 races. The reverse rotation of the transferring roller 22 is transmitted to the delivery roller 32 through the gear g13 and clutch c4. At this time, the clutch c5 races. Accordingly, the delivery roller 32 is rotated in the document transferring direction (forward direction) with either the forward rotation or the reverse rotation of the transferring roller 22 as shown in FIG. 8 and FIG. 9.

Likewise as shown in FIG. 8 and FIG. 9, the rotation of the gear g12 is imposed to the changeover means 33 through the timing belt b4 and the torque clutch t3, thereby to either close the return passage w5 when the transferring roller 22 rotates in the forward direction or close the discharge passage w4 when the transferring roller rotates in the reverse direction.

The delivery roller 34 rotates in the direction in which the document is discharged in response to the forward rotation of the transferring roller 22, which is transmitted through the gear g15 engaged with the gear g12 and the one-way clutch c6 (FIG. 8 and FIG. 10).

That is to say, when beginning to feeding the document (FIG. 6), the kick roller 12 and the feed roller 16*a* rotate in the document transferring direction (forward direction) by rotating the motor MT reversely to bring the electromagnetic clutch e1 to its connected state, consequently to rock the pressure means 13 downward, but the registering roller 17*a* does not rotate at this time. Hence, the document stacked on the supply tray 11 drawn out from the supply tray by rotating the kick roller 12 and sent into the supply passage w1 by the feed roller 16*a* in rotation. As a result, the second electromagnetic clutch e2 assumes its "disconnected" state, thus suspend both the document transferring mechanism 20 and the document discharging mechanism 30.

In performing the registering operation (FIG. 7), the motor MT rotates forward to rock the pressure means 13 upward and rotate the registering roller 17*a* in the forward direction, so that the document advancing along the supply passage w1 is sent toward the document reading station R.

In performing the document discharging operation (FIG. 8) upon completion of the document reading processing on the document reading station R, the motor MT rotates forward and the second electromagnetic clutch e2 assumes its "connected" state, thus to drive the transferring rollers 21 and 22 of the document transferring mechanism 20 through the medium of the document transferring means 23 and further to rotate both the delivery roller 32 and the discharge rollers 34 of the document discharging mechanism 30 in the forward direction. At this time, the return passage w5 is closed by the changeover means 33, thus allowing the document to advance from the transfer passage w3 to the discharge passage w4 and to be discharged onto the discharge tray 31.

In the document inverting operation (FIG. 9) for dealing with the duplex document having information to be read or copied on both sides, the motor MT is operated in the reverse direction to rotate the transferring rollers 21 and 22 in the reverse direction. Simultaneously, the bidirectional clutch composed of the clutches c4 and c5 allows the delivery roller 32 to continuously rotate in the forward direction, but it causes the changeover means 33 to rock upward to close the discharge passage w4 and open the return passage w5. Thus, the document advancing along the transfer passage w3 is introduced into the return passage w5 and sent toward the document reading station R.

The manual insertion mode shown in FIG. 10 is equivalent to the situation in which the second electromagnetic clutch e2 is brought to its "connected" state in the registering mode as shown in FIG. 7, consequently to operate the document transferring mechanism 20.

As is described above, the automatic document feeding apparatus of the invention can fulfill various document feeding modes merely by controlling the connecting and disconnection action of the first and second electromagnetic clutches and the rotational direction of the motor MT.

To be more specific, the forward rotation of the motor MT is transmitted to the pressure means 13 and the registering roller 17*a* of the registering means 17 through the clutches t1 and c3. When the motor MT is reversed, the kick roller 12 and feed roller 16*a* of the document separating means 16 are driven. The manual insertion shutter 18*b* is operated when the motor MT rotates in either of the forward and reverse directions. The rotation of the motor MT is selectively transmitted to the transferring roller 21 of the document transferring mechanism 20 through the second electromagnetic clutch e2 and further to the document discharging mechanism 30 through the document transferring mechanism 20, so that the delivery roller 32 is rotated in the document transferring direction (forward direction) when the motor MT rotates in either forward or reverse direction. The discharge rollers 34 rotate when the motor MT rotates forward and are suspended when the motor MT rotates reversely. The changeover means 33 takes its lower position to close the return passage w5 when the motor MT rotates forward, and it takes its upper position to close the discharge passage w4 when the motor MT is reversed.

Figure 12A:
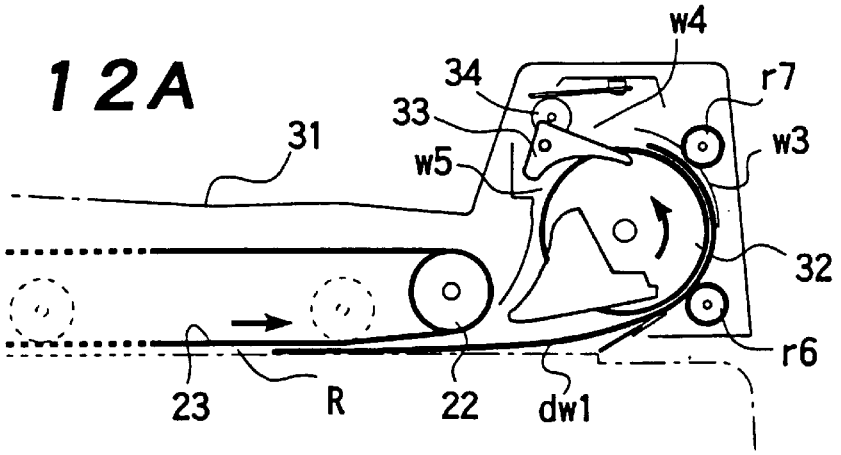
FIG. 12A through FIG. 12C are schematic side views showing the manner of feeding the document in a duplex copying mode.
Figure 12B:
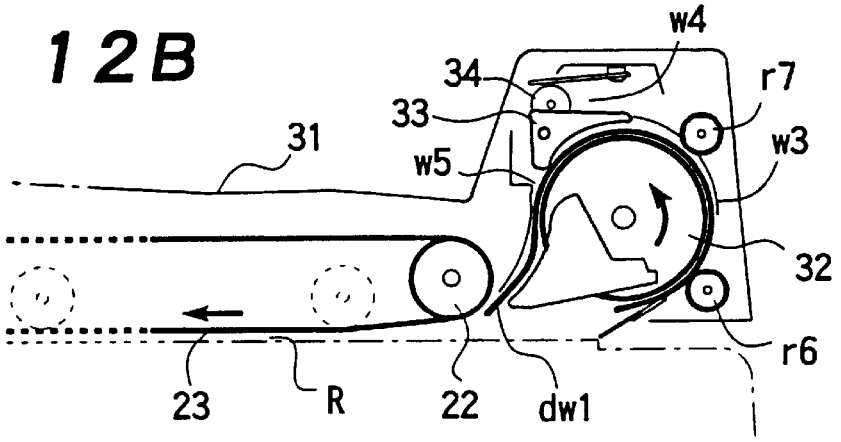
Figure 12C:
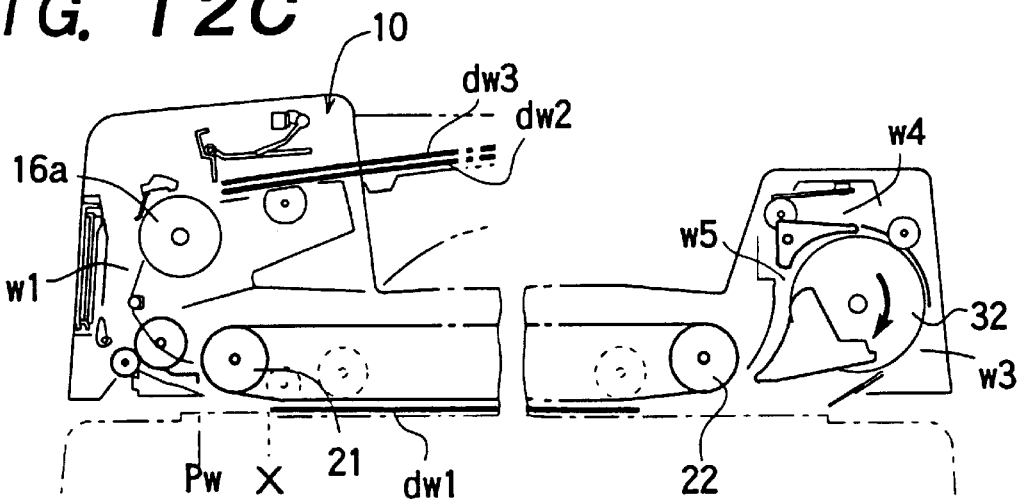
Figure 13A:
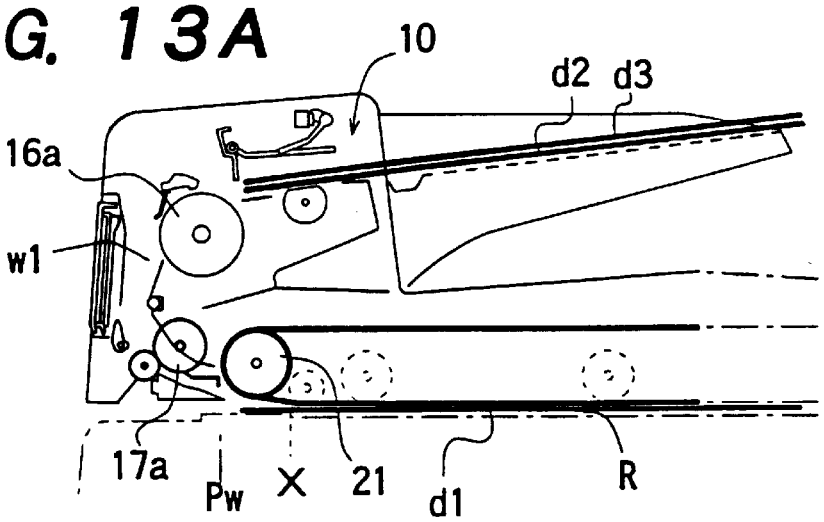
FIG. 13A through FIG. 13C are schematic side views showing the manner of feeding the document in a 2-in-1 copying mode.
Figure 13B:
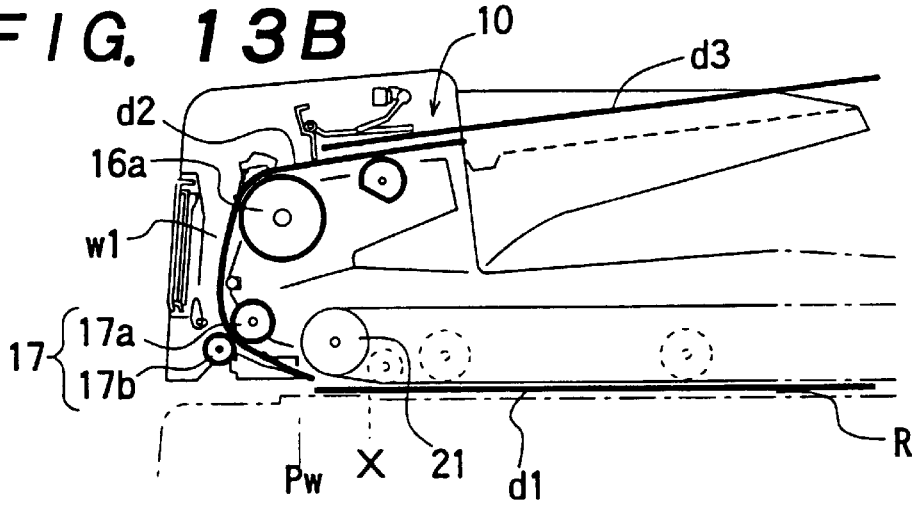
Figure 13C:
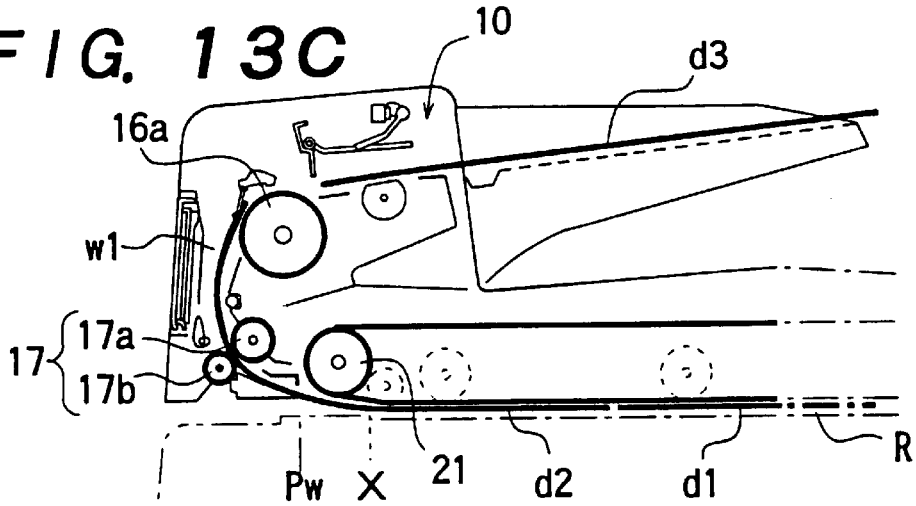

Next, the document copying modes which can be accomplished by the invention will be described in the concrete. FIG. 11A through FIG. 11I illustrate the process of dealing with a simplex original document having information to be read or copied on one side in a simplex copying mode. FIG. 12A through FIG. 12C illustrate the process of dealing with a duplex original document having information to be read or copied on both sides in a duplex copying mode. FIG. 13A through FIG. 13C illustrate the process of dealing with two original documents placed side by side at one time in a 2-in-1 copying mode.

In any mode, the document feeding apparatus ADF carries an initial operation into practice at the outset, as shown in FIG. 5. That is, the motor MT preliminarily rotates forward for a short time to operate the pressure means 13 and the registering means 17, and simultaneously, operate the manual insertion shutter 18*b* to open the manual insertion passage w2, thus standing ready for feeding the first document.

Figure 11A:
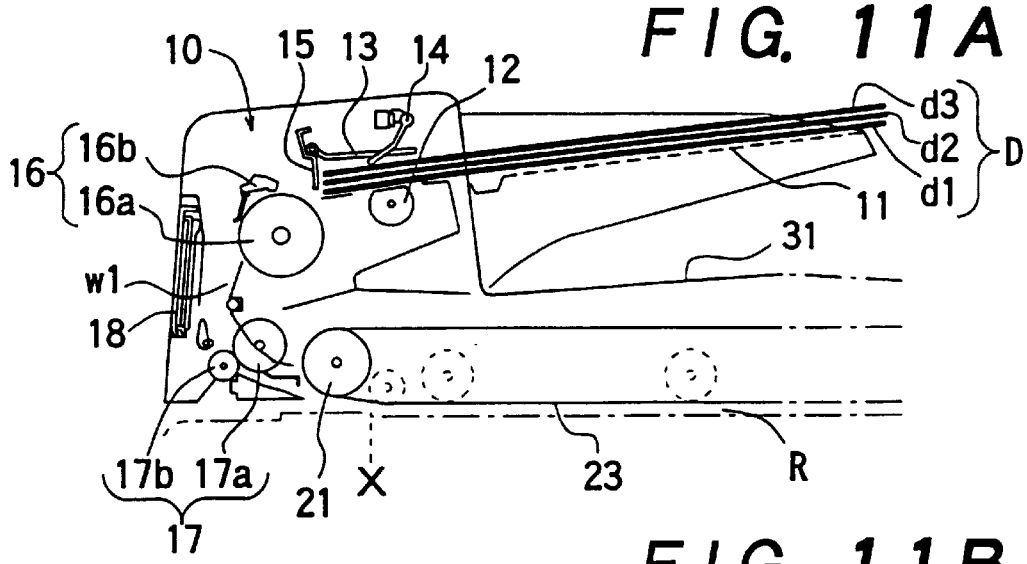
FIG. 11A through FIG. 11I are schematic side views showing the manner of feeding the document in a simplex copying mode.

FIG. 11A shows the state of stacking one or more documents D (d1,d2,d3, . . . ) to be read on the supply tray 11 of the apparatus ADF standing by ready to feed the document. The document feeding apparatus assumes such a standby state in either simplex or duplex copying mode.

Figure 11B:
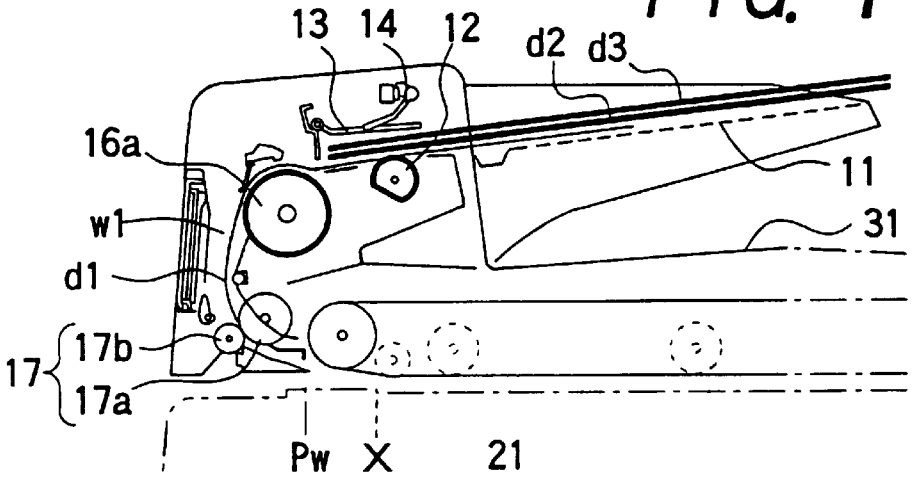

Then, by depressing a start switch of the copying machine M, the motor MT starts to rotate in the reverse direction to rotate the kick roller 12 and feed roller 16*a* in the forward direction to send out the lowermost document d1 of the documents stacked on the supply tray 11 into the supply passage w1, as shown in FIG. 11B and FIG. 6. Further reverse rotation of the motor causes the document sent from the supply tray to advance toward the registering means 17 through the document separating means 16 while preventing two or more documents from passing therethrough as touched upon above.

As shown in FIG. 11B, even though the document d1 advancing along the supply passage w1 collides with the contact line of the registering rollers 17*a* and 17*b*, the registering means 17 is still at rest. Then, the document d1 colliding with the registering rollers is further forwarded a little, so that the leading end part of the document is slightly bent while bringing the entire leading edge of the document into alignment with the contact line of the registering rollers 17*a* and 17*b*, which is perpendicular to the document transferring direction as shown in FGI. 11C. At that time, the motor MT is reversed to produce reverse rotation.

The reverse rotation of the motor MT is transmitted to the registering roller 17*a* through the one-way clutch c3 attached to the rotational shaft a17, to rotate the registering roller 17*a* in the forward direction, as shown in FIG. 7. As a result, even though the document is sent aslant from the supply tray 11, it can pass through the registering means 17 in its proper posture directed to the document forwarding direction (registering function).

After the document d1 passes through the registering means 17, the second electromagnetic clutch e2 is changed to its "connected" state to drive the document transferring mechanism 20, as shown in FIG. 8. As a result, the document is sent into the document reading station R prescribed on the copying machine M (FIG. 11D).

When the document passes through the registering means 17, the length of the document is measured by the registering sensor s1.

Figure 11C:
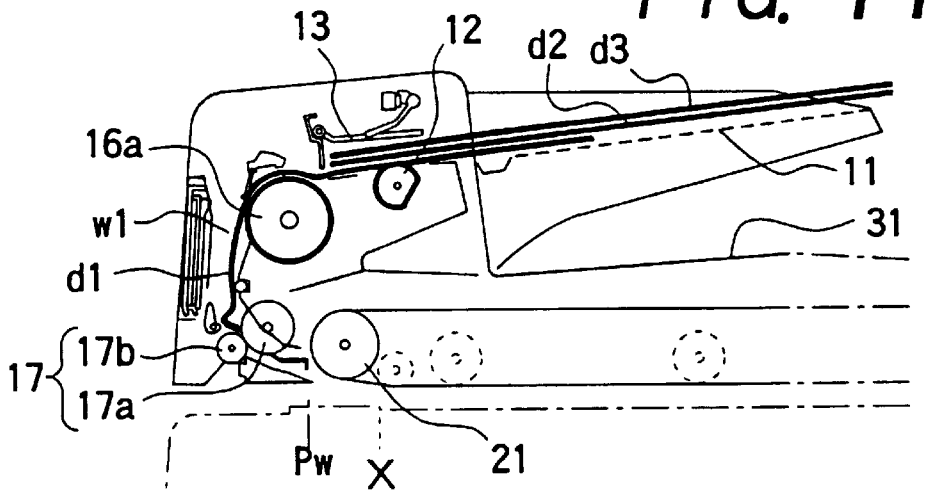
Figure 11D:
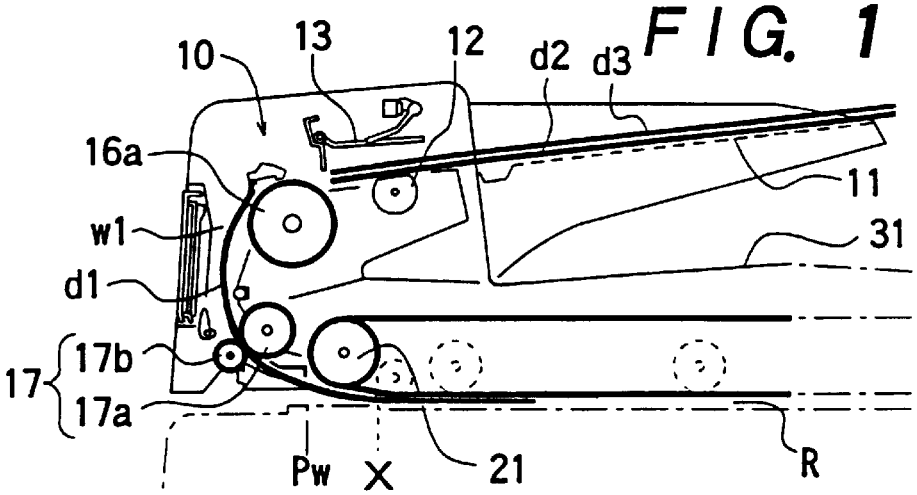
Figure 11E:
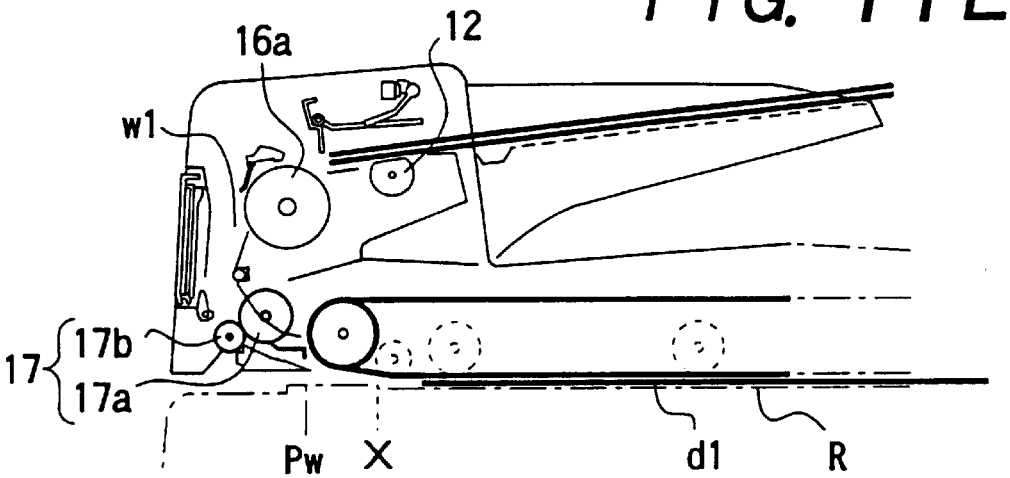

Although, in course of time, the entire document is sent into the document reading station R, and then, the tail end of the document arrives at the reading reference point X, the document continues advancing in the forward direction as shown in FIG. 11E. When the leading end of the document being forwarded along the document reading station R is detected by the sensor s1, a counter begins to take count of rotating pulses supplied to the motor MT. When the rotating pulses given to the motor comes up to a predetermined number, the motor MT is reversed to rotate at low speed in the reverse direction (switchback function). By quantitatively rotating the motor MT in accordance with the length of the document which was previously measured, the document being sent backward can be exactly situated at a correct document reading position in the document reading station.

The switchback function serves to not only position the document at the correct document reading position, but also successfully correct a positional error of the document which may possibly be caused when, for example, moving the document along the supply passage w1 at high speed.

Upon completion of positioning the document at the document reading position in the manner described above (i.e. the tail end of the document being positioned at the reference point X), the copying machine M performs the desired image reading processing for reading out the information on the document. In the document feeding apparatus of the invention, in the process of reading out the first document d1 in the copying machine M, the succeeding second document d2 is fed toward the document wait point Pw.

Figure 11F:
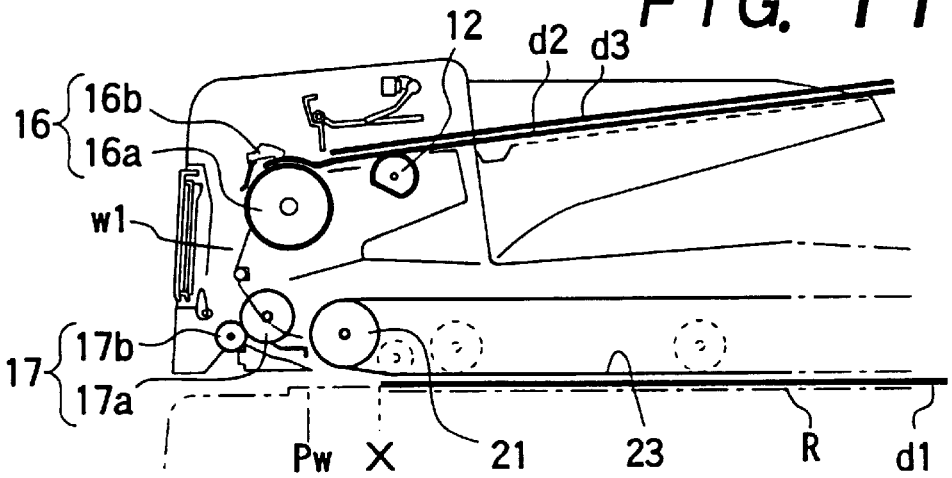

That is to say, in carrying out the image reading processing for the first document, the motor MT is reversed to operate the kick roller 12, pressure means 13 and feed roller 16*a* in the same state as the document feeding operation state as described above with reference to FIG. 6, thus to send the succeeding second document d2 into the supply passage w1 as illustrated in FIG. 11F.

Figure 11G:
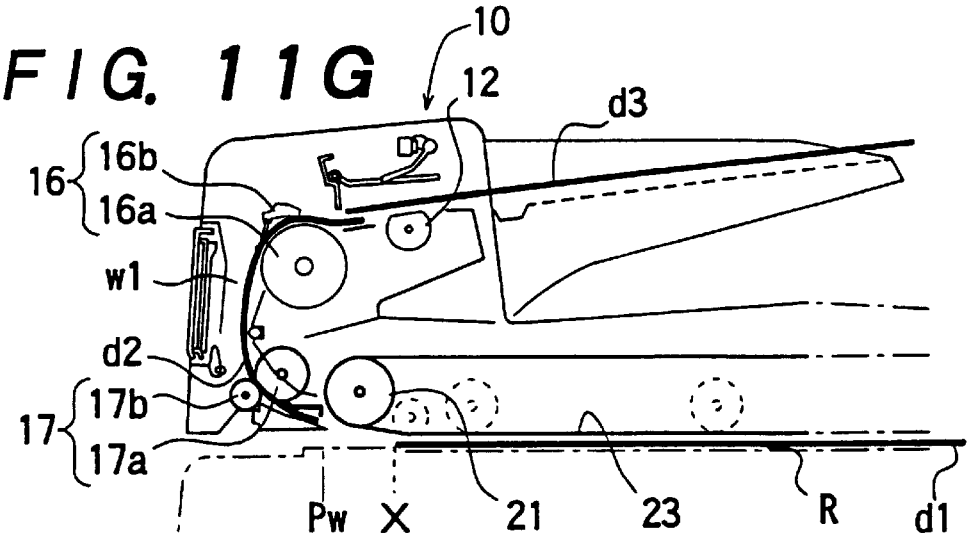

To be more specific, similarly to the first document d1, the second document d2 continues to move forward until the leading end of the second document d2 arrives at the document wait point Pw, as shown in FIG. 7 and FIG. 11C. However, even though the second document has reached the document wait point Pw, the motor MT is at rest until the reading processing for the first document d1 is finished, to put the second document d2 on standby at the document wait point (FIG. 11G).

Figure 11H:
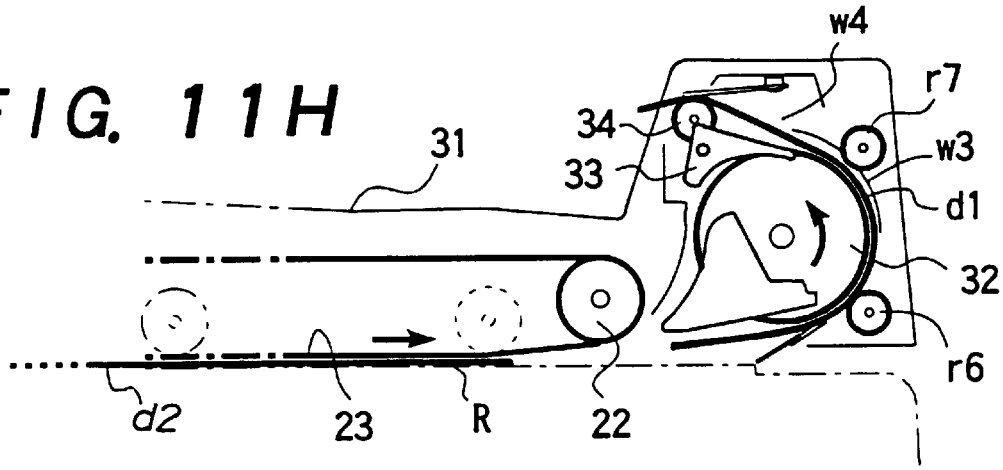
Figure 11I:
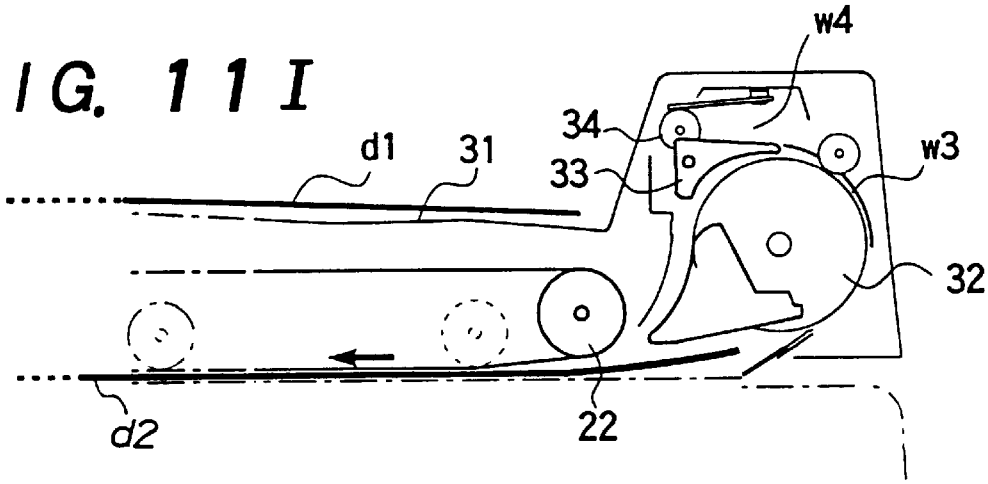

When the document reading processing for the first document d1 in the copying machine M is finished, the motor MT starts rotating in the forward direction, and the second electromagnetic clutch e2 is brought into its "connected" state to drive the document transferring mechanism 20 and the document discharging mechanism 30 as shown in FIG. 8. As the motor MT rotates forwardly, the changeover means 33 takes its lower position to secure a path from the transfer passage w3 to the discharge passage w4. Consequently, the first document d1 is sent out to the discharge tray 31 through the transfer passage w3 and the discharge passage w4, as shown in FIG. 11H and FIG. 11I.

While the first document d1 advances toward the discharge tray, the second document d2 is partially sent into the transfer passage w3, following to the first document d1. However, by taking count of rotational pulses of the motor MT from the time at which the second document d2 is detected by the document sensor s1 to recognize the length by which the second document enters excessively into the transfer passage w3, the second document d2 partially entering into the transfer passage w3 can be exactly sent back to the prescribed document reading position by reversing the motor in accordance with the length measured on the basis of the counted rotating pulses of the motor. Namely, the second document passing over the document reading position can be exactly returned to the proper document reading position by the switchback operation as shown in FIG. 11E.

The second document d2 thus situated in the document reading position is subjected to desired image processing in the copying machine M. In the meantime, the succeeding third document d3 is sent to the document wait point Pw in the same manner as described above, and the same process as above is carried out in much the same way as of the preceding documents.

Dissimilar to the manner for handling simplex documents in the simplex copying mode as described above, in the duplex copying mode, the succeeding document is not sent out from the supply tray 11 until the document reading processing for the preceding document is finished.

The preceding duplex document dw1 upon completion of the document reading processing is sent from the document reading position on the copying machine into the document discharging mechanism 30 by rotating the motor MT in the forward direction, as shown in FIG. 11G. Immediately before the document dw1 advancing along the transfer passage w3 reaches the changeover means 33, the motor MT is reversed as shown in FIG. 9, consequently rocking the changeover means 33 upward to close the discharge passage w4 and permit the transfer passage w3 to communicate with the return passage w5. Even though the motor MT rotates reversely, the discharge rollers 34 continue to rotate in the forward direction due to the bidirectional clutch composed of the clutches c4 and c5. As a result, the duplex document dw1 is sent back to the document reading station R through the return passage w5 in the inverted state. At this time, on the principle as described above with reference to FIG. 11E and FIG. 11F, the document dw1 is situated at the proper reading position (FIG. 12C).

In inverting the duplex document dw1 in the manner shown in FIG. 12A and FIG. 12B, the document supplying mechanism 10 is at rest due to the first electromagnetic clutch e1 in the "disconnected" state as shown in FIG. 9. In this resting state, the succeeding second document dw2 is not sent out from the supply tray 11.

At the time that the preceding first duplex document dw1 is discharged to the discharge tray 31 upon completion of the document reading processing for the first document in the manner illustrated in FIG. 11H and FIG. 11I, the succeeding second duplex document dw2 is sent toward the document reading station in the same manner as described above.

FIG. 13A through FIG. 13C illustrate the processes of copying two documents d1 and d2 placed side by side on the document reading station R in one reading operation in the 2-in-1 mode.

The process of forwarding the first document d1 toward the document reading station R is the same as that described above with reference to FIG. 11A through FIG. 11D. That is, until the tail end of the first document d1 reaches the document wait point Pw, the document d1 is forwarded by the function of the document supplying mechanism 10 as described above with reference to FIG. 6 and FIG. 8.

When the tail end of the first document d1 arrives at the document wait point Pw, the motor MT, which has rotated forward up to this time, is reversed, and the second electromagnetic clutch e2 is brought to its disconnected state. Thus, as shown in FIG. 6, the document transferring mechanism 20 is suspended while stopping the first document with its tail end positioned at the document wait point Pw, but the second document d2 is sent into the supply passage w1 until the leading end of the document d2 reaches the document wait point Pw through the registering means as shown in FIG. 7.

Then, by bringing the second electromagnetic clutch e2 to its connected state, the first document d1 and second document d2 together are sent into the document reading station R (FIG. 13C). Consequently, the two documents placed side by side on the document reading station can be copied in one reading operation.

The manner of simultaneously discharging the two documents from the document reading station and feeding another set of documents from the supply tray to the document reading station in sequence in the duplex copying mode are the same as that in the simplex copying mode as described above.

Figure 14A:
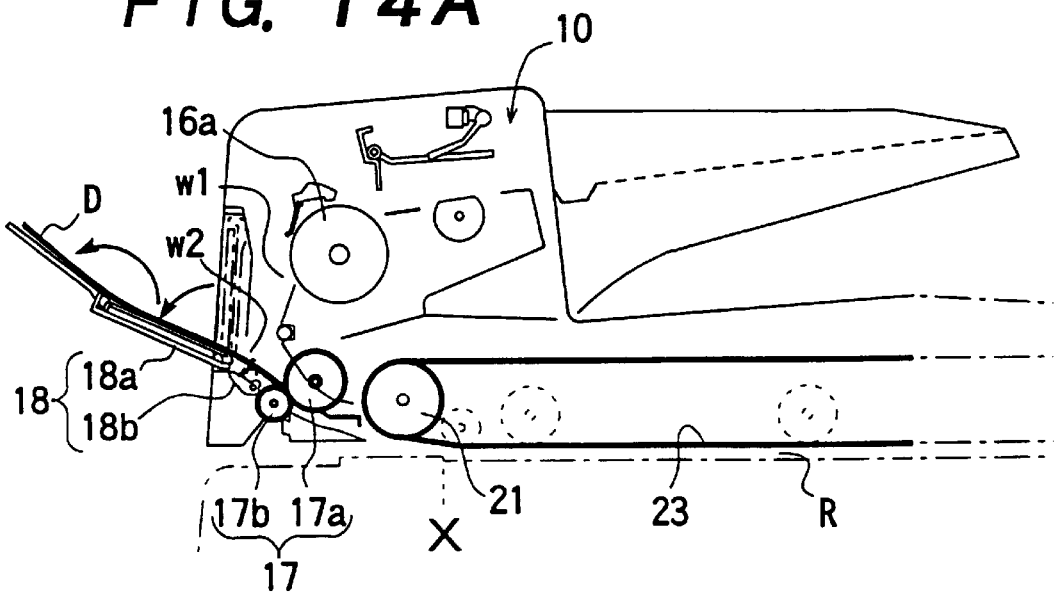
FIG. 14A and FIG. 14B are schematic side views showing the manner of feeding the document in a manual insertion mode.
Figure 14B:
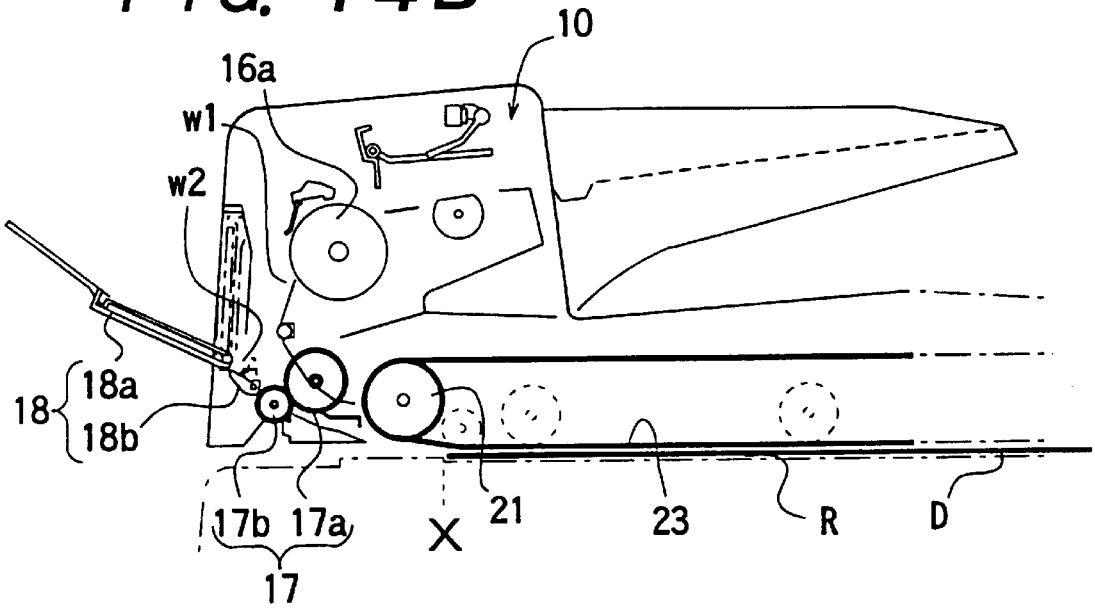

FIG. 14A and FIG. 14B illustrate the manner of manually introducing a document into the document feeding apparatus in the manual insertion mode. First of all, the manual insertion tray 18*a* is opened, and the document D to be read or copied is inserted by hand along the manual insertion tray 18*a* into the manual insertion passage w2, as shown in FIG. 14A. When the document thus inserted is detected by the document sensor s1, the registering means 17 is automatically operated to forward the document toward the document reading station R. At this time, the first electromagnetic clutch e1 is disconnected, and the second electromagnetic clutch e2 is connected.

Thereafter, the document is sent back a little to be located at the prescribed document reading position as shown in FIG. 11E. Upon completion of the document reading processing there, the document is discharged to the discharge tray 31 in the same manner as described with reference to FIG. 8.

As is apparent from the foregoing description, according to the automatic document feeding apparatus of the invention, the driving components constituting the document supplying mechanism, document transferring mechanism, and document discharging mechanism of the apparatus can be arbitrarily operated rationally with high efficiency in accordance with one selected from the simplex copying mode, duplex copying mode, 2-in-1 copying mode and manual insertion mode by a simple mechanical system using the single reversible drive source and the motion transmitting system with two electromagnetic clutches. The document feeding apparatus of the invention can easily be composed of a relatively small number of components including the two electromagnetic clutches, and enables the whole system for handling documents to be operated at high speed with certainty by merely controlling the direction of rotation of the motor and the connecting and disconnecting action of the two electromagnetic clutches.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. An automatic document feeding apparatus comprising:

a document supplying mechanism including a document supply tray for stacking one or more original documents, at least one kick roller for sending out the documents from said document supply tray one by one, pressure means opposed to said kick roller, document separation means for permitting one document from said document supply tray to pass therethrough, and registering means for correcting inclination of the document being forwarded;

a document transferring mechanism including transferring means rotatable in forward and reverse directions to transfer the document along a document reading station in either forward or reverse direction;

a document discharging mechanism including a document discharge tray for receiving the documents discharged, a transfer passage for forwarding the document sent from said document transferring mechanism therealong, a delivery roller for sending the document along said transfer passage, a discharge passage for discharging the document sent from said transfer passage to said document discharge tray, a return passage for forwarding the document from said transfer passage toward said document reading station to cause the document to be inverted, and a changeover means for introducing the document sent from said document reading station via said transfer passage selectively to said discharge passage or said return passage; and a motion transmitting system including a single reversible drive source for driving said document supplying mechanism, said document transferring mechanism and said document discharging mechanism, a first electromagnetic clutch disposed between said drive source and said kick roller and separating means, a second electromagnetic clutch disposed between said drive source and said document transferring mechanism, and a one-way clutch disposed between said first electromagnetic clutch and said kick roller, said kick roller and said separating means being driven in the forward direction by operating said drive source in the reverse direction, and at least one of said registering means and said document discharging mechanism being driven when operating said drive source in the forward direction.

2. An apparatus as claimed in claim 1, wherein said motion transmitting system is provided between said drive source and the pressure means with a torque clutch for allowing said pressure means to rockingly move with the forward or reverse rotation of said drive source.

3. An apparatus as claimed in claim 1, wherein said motion transmitting system is provided between said drive source and the separating means with a clutch for rotating said separating means in the forward direction with the forward rotation of said drive source.

4. An apparatus as claimed in claim 1, wherein said motion transmitting system includes a clutch placed between said drive source and the pressure means to allow said pressure means to rockingly move with the forward or reverse rotation of said drive source, and another clutch placed between said drive source and the separating means to rotate said separating means in the forward direction with the forward rotation of said drive source.

5. An apparatus as claimed in claim 1, wherein said motion transmitting system includes a clutch placed between said drive source and the pressure means to allow said pressure means to rockingly move with the forward or reverse rotation of said drive source, and another clutch placed between said drive source and the separating means to rotate said separating means in the forward direction with the forward rotation of said drive source.

6. An apparatus as claimed in claim 1, wherein said drive source is connected to said document discharging mechanism through said second electromagnetic clutch and said transferring means.

7. An apparatus as claimed in claim 6, wherein said delivery roller is connected to said transferring means through two one-way clutches each for transmitting rotation in opposite directions, to rotate said delivery roller in the forward direction whenever said transferring means is driven in either forward or reverse direction.

8. An apparatus as claimed in claim 6, wherein said motion transmitting system is provided between said changeover means and said transferring means with a torque clutch, said changeover means being operated to selectively close said return passage with the forward rotation of said transferring means and close said discharge passage with the reverse rotation of said transferring means.

9. An apparatus as claimed in claim 6, wherein said document discharging mechanism further includes discharge rollers disposed on said discharge passage to send out the document to said discharge tray, said discharge rollers being connected to said transferring means through a one-way clutch to be rotated in the forward direction with the forward rotation of said transferring means.

10. An apparatus as claimed in claim 6, wherein said delivery roller is connected to said transferring means through two one-way clutches each for transmitting rotation in opposite directions, to rotate said delivery roller in the forward direction whenever said transferring means is driven in either forward or reverse direction, and wherein said motion transmitting system is provided between said changeover means and said transferring means with a torque clutch, said changeover means being operated to selectively close said return passage with the forward rotation of said transferring means and close said discharge passage with the reverse rotation of said transferring means, said document discharging mechanism further including discharge rollers disposed on said discharge passage to send out the document to said discharge tray, said discharge rollers being connected to said transferring means through a one-way clutch to be rotated in the forward direction with the forward rotation of said transferring means.

11. An apparatus as claimed in claim 1, further comprising a manual insertion tray on said supply passage to allow a document to be manually inserted into said supply passage, and a manual insertion shutter driven to open or close by said drive source.

12. An apparatus as claimed in claim 1, wherein said document separating means comprises a separating feed roller and a separation pad coming into press contact with said feed roller, said feed roller being rotatable with the rotation of said drive source.

13. An apparatus as claimed in claim 1, wherein said registering means comprises a pair of opposed registering rollers rotatable with the rotation of said drive source.

14. An automatic document feeding apparatus overlaying a document reading station defined on a copying machine, for feeding and discharging one or more documents one by one relative to the document reading station selectively in a simplex copying mode for dealing with a simplex document, a duplex copying mode for dealing with and inverting a duplex document, and a 2-in-1 mode for dealing with two documents placed side by side on said document reading station, which comprises:

a document supplying mechanism including a document supply tray for stacking one or more original documents, at least one kick roller for sending out the documents from said document supply tray one by one, pressure means opposed to said kick roller, document separation means for permitting one document from said document supply tray to pass therethrough at one time, and registering means for correcting inclination of the document being forwarded;

a document transferring mechanism including transferring means rotatable in forward and reverse directions to transfer the document along a document reading station in either forward or reverse direction;

a document discharging mechanism including a document discharge tray for receiving the documents discharged, a transfer passage for forwarding the document sent from said document transferring mechanism therealong, a delivery roller for sending the document along said transfer passage, a discharge passage for discharging the document sent from said transfer passage to said document discharge tray, a return passage for forwarding the document from said transfer passage toward said document reading station to cause the document to be inverted, and a changeover means for introducing the document sent from said document reading station via said transfer passage selectively to said discharge passage or said return passage; and a motion transmitting system including a single reversible drive source for selectively driving said document supplying mechanism, a first electromagnetic clutch disposed between said drive source and said kick roller and said separating means, and a second electromagnetic clutch disposed between said drive source and said document transferring mechanism to drive said document discharging mechanism with the rotation transmitted through said document transferring mechanism and selectively transmit the rotation of said drive source to said document transferring mechanism and said document discharging mechanism in accordance with one selected from said simplex copying mode, said duplex copying mode and said 2-in-1 mode.

15. An apparatus as claimed in claim 14, wherein said motion transmitting system is provided between said drive source and the pressure means with a clutch for rockingly moving said pressure means with the forward or reverse rotation of said drive source, and wherein said motion transmitting system is provided between said drive source and the separating means with a clutch for rotating said separating means in the forward direction with the forward rotation of said drive source.

16. An apparatus as claimed in claim 14, wherein said delivery roller is connected to said transferring means through two one-way clutches each for transmitting rotation in opposite directions, to rotate said delivery roller in the forward direction whenever said transferring means is driven in either forward or reverse direction, and wherein said motion transmitting system is provided between said changeover means and said transferring means with a torque clutch, said changeover means being operated to selectively close said return passage with the forward rotation of said transferring means and close said discharge passage with the reverse rotation of said transferring means, said document discharging mechanism further including discharge rollers disposed on said discharge passage to send out the document to said discharge tray, said discharge rollers being connected to said transferring means through a one-way clutch to be rotated in the forward direction with the forward rotation of said transferring means.

17. An apparatus as claimed in claim 14, further comprising a manual insertion tray on said supply passage to allow a document to be manually inserted into said supply passage, and a manual insertion shutter driven to open or close by said drive source.

* * * * *